US005203718A

United States Patent [19]

Chishima

[11] Patent Number: 5,203,718

[45] Date of Patent: Apr. 20, 1993

[54] CONNECTOR

[75] Inventor: Masamitsu Chishima, Mie, Japan

[73] Assignee: Sumitomo Wiring Systems Ltd., Mie, Japan

[21] Appl. No.: 773,003

[22] Filed: Oct. 8, 1991

[30] Foreign Application Priority Data

Oct. 8, 1990 [JP] Japan ..... 2-106178[U]
Nov. 5, 1990 [JP] Japan ..... 2-300434
Nov. 13, 1990 [JP] Japan ..... 2-118624[U]

[51] Int. Cl.[5] ..... H01R 3/00

[52] U.S. Cl. ..... 439/489; 439/488; 439/350

[58] Field of Search ..... 439/350, 358, 488, 489

[56] References Cited

U.S. PATENT DOCUMENTS 4,634,204 1/1987 Detter et al. ..... 439/352
4,693,533 9/1987 Szczesny et al. ..... 439/404
4,871,323 10/1989 Ohsumi ..... 439/188
4,902,244 2/1990 Endo et al. ..... 439/489
4,946,395 8/1990 Cope et al. ..... 439/352
5,061,204 10/1991 Mumkami ..... 439/489
5,066,244 11/1991 Kato et al. ..... 439/489

FOREIGN PATENT DOCUMENTS 0090502 10/1983 European Pat. Off. .

OTHER PUBLICATIONS

U.K. Patent Office Search Report, dated Jan. 21, 1992.

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

A connector constructed such that the front half portions of a pair of connector housings each accommodating a terminal are coupled with each other and are locked and connected together by a pair of first locking means. This connector comprises a detecting spacer locked and connected to one of the pair of connector housings by second locking means and a lock-releasing means provided on the other connector housing for releasing locking between the detecting spacer and the one connector housing when the other connector housing is properly coupled with the one connector housing.

10 Claims, 18 Drawing Sheets

CONNECTOR

BACKGROUND OF THE INVENTION

1. Field of the Invention

The present invention relates to a connector in which a pair of connector housings are coupled and connected together so as to establish an electrical connection, and more particularly to a connector having a coupling detecting mechanism for detecting whether or not the pair of connector housings are properly coupled together or a connector having a lock confirming mechanism for confirming the coupled posture of the pair of connector housings as well as the coupling detecting mechanism.

2. Statement of the Prior Art

The official gazette of Japanese Patent Public Disclosure (Kokai) No. 62-160674 (not examined) discloses a coupling detecting mechanism as a means for preventing the occurrence of partial coupling of a pair of connector housings in which the pair of connector housings are not properly coupled together because a distance by which the connector housings are actually being mated is too short. Namely, in a connector of this known type, a bar-like separate detecting spacer is mounted and locked on the upper side of one connector housing in a direction in which the one connector housing is coupled with the other connector housing, and this bar-like detecting spacer is then pushed forward after the two connector housings are coupled together to see whether the leading end of the detecting spacer "protrudes or not" from a detecting portion situated on the upper side of the connector in a coupled posture whereby whether the two connector housings are coupled properly or partially is visually judged.

In addition, there are many connectors having a coupled posture locking mechanism in which a resilient locking member provided on one of a pair of connector housings is mated with a locking pawl provided on the other connector housing for locking the two connector housings in a properly coupled posture.

With the above known connector having a coupling detecting mechanism, it is possible to effect a visual confirmation of the coupling condition of the connector by confirming the degree of protrusion of the detecting spacer. However, the connector of this known type has the following drawbacks.

In a connector for a wiring harness for an automobile, there are many cases in which connector housings are connected together in a limited space, and in a particular case, connector housings have to be connected together by feel, in which case the visual confirmation described above is not possible.

In the case of a connector in which the connector housings are not connected together due to oversight, it is impossible to detect an unconnected condition. In order to make it possible to effect a proper visual confirmation of the status of the detecting spacer, the connecting posture of the connector has to be limited such that the leading end of the detecting spacer may be easily seen.

In the case of a connector in which the associate connector housing is mounted on an apparatus, it is not possible to provide a detecting portion for detecting the leading end of the detecting spacer on the associate connector housing, and therefore it is not possible to adopt this coupling detecting mechanism.

In the coupled posture locking mechanism described above, visual or audible confirmation is not reliable when the connecting operation is conducted in a noisy place or where it is difficult to see the connected portion, since the coupling detecting depends on the sound resulting from the resilient lock piece engaging with the lock pawl or the external appearance of the coupled housings. When the locking mechanism is not properly engaged, a test for conductivity is positive so long as the terminals contact with each other. If such an improperly coupled connector is used in a car, conduction failure may be caused by vibration. Consequently, the locking mechanisms unreliable.

In addition, the official gazette of Japanese Patent Public Disclosures (Kokai) Nos. 1-109671 and 63-225480 (not examined) disclose applications of a photo-sensor used as a detecting and confirming mechanism for the connector coupling. These known mechanisms include a light-generating device which project light onto a confirmation aperture or mark formed on each of the connector housings to detect the connector coupling.

These mechanisms always require a light-generating device. In a wiring harness for a car in which the connector is disposed in various and complicated positions including many electric wires, it is often difficult to apply the light sensor to the connector. Thus, the detection and confirmation of the coupled connector using the light-generating device requires of complicated operations and is not many suitable for a modern mass production system.

SUMMARY OF THE INVENTION

An object of the present invention is to obtain a connector in which proper coupling of a pair of connector housings is securely detected.

Another object of the present invention is to obtain a detecting spacer capable of being taken out only when a pair of connector housings are properly coupled together.

Still another object of the present invention is to make confirmation coupling of an entire wiring harness easy and reliable by applying a barcode indication to the detecting spacer.

With a view to accomplishing the above objects, the present invention provides a connector in which the front half portions of a pair of connector housings each accommodating a terminal are mated with each other and locked together by means of a pair of locking means, the connector comprising a detecting spacer that is locked and connected to one of the pair of connector housings by means of another pair of locking means, and a lock-releasing portion provided on the other connector housing for releasing the lock between the detecting spacer and the one connector housing when the two connector housings are properly coupled together.

An optimum embodiment of a connector according to the present invention is characterized in that the front half portions of a pair of connector housings each accommodating a terminal are coupled with each other; that said first locking means constitute a posture locking mechanism including a cantilever type of resilient lock piece formed on the one connector housing and a lock pawl formed on the other connector housing, said lock pawl being adapted to engage said lock piece by elastically deflecting and recovering said lock piece; that said second locking means constitute a withdrawal locking mechanism including a pair of resilient fingers formed on said detecting spacer and a pair of lock portions formed on the one connector housing, said lock portions being adapted to engage said resilient fingers to prevent said detecting spacer from withdrawing from the one connector housing; that said detecting spacer has a detecting finger adapted to engage a free end of said lock piece when said piece is elastically deflected by said lock pawl; and that said lock-releasing means include a pair of release portions which engage with the ends of said resilient fingers so that said means can release said withdrawal locking mechanism when said connector housings are properly coupled with each other.

In the connector of the present invention, when the pair of connector housings are put in a proper coupled posture and the first locking means is properly locked, the detecting spacer can be released from the locked condition, while the detecting spacer can not be released when the connector housings are improperly or partially coupled with each other.

In the connector of the present invention, each of said resilient fingers has a first downward pawl at its free end. The first downward pawl is adapted to engage said lock portion on the one connector housing. The detecting finger has an upward facing pawl at its free end. The upward facing pawl is adapted to engage the free end of said lock piece on the one connector housing when said lock piece is elastically deflected. Each of the release portions is formed into a tongue projected in the interior of the other connector housing and directed to said first downward facing pawl of said resilient finger.

The detecting finger may be provided with a window for receiving said lock piece at the front portion and the front edge of said window serves as a stop for the free end of said lock piece.

In the connector of the present invention, as described above, when the pair of connector housings are properly coupled, the detecting spacer which was locked to the one connector housing by the withdrawal locking mechanism is released from the one connector housing by the release portions on the other connector housing to be freely withdrawn. If the connector housings are improperly or partially coupled with each other, the withdrawal locking mechanism continues to lock the spacer. Accordingly, it is possible to detect the proper coupling of the connector under the condition that the detecting spacer can be withdrawn from the one connector housing.

Also, when the pair of connector housings are properly connected with each other so that the lock piece of the one connector housing engages with the lock portion of the other connector housing, the end of the lock piece which is recovered to the normal position does not interfere with the detecting finger of the detecting spacer. The detecting spacer can be pulled from the one connector housing. When poor locking is caused due to improper coupling, the end of the deflected lock piece interfers with the detecting finger so that the spacer can not be withdrawn. Consequently, visual and audible detection of the connector coupling is reliable and accurate.

Also, in the case of poor coupling, the withdrawing action of the detecting spacer can be doubly prevented by both the lock-releasing means and the withdrawal locking mechanism. Thus coupling detection will be more reliable.

In the connector of another embodiment of the present invention the second locking means constitute a withdrawal locking mechanism including a pair of resilient fingers formed on said detecting spacer and a pair of lock portions formed on the one connector housing. Each of said resilient fingers is provided with an outside pawl at the free end. The lock portions are adapted to engage said outside pawls respectively to prevent said detecting spacer from withdrawing from the one connector housing. The lock-releasing means is provided with release portions for engaging said outside pawls of said resilient fingers when said connector housings are properly coupled with each other.

In the connector of still another embodiment of the present invention the second locking means constitute a withdrawal locking mechanism including a resilient plate extending from said detecting spacer and a pair of resilient levers formed on the one connector housing. The resilient plate is provided with a recess at the opposite sides. The resilient levers are adapted to engage with said recesses respectively to prevent said detecting spacer from withdrawing from the one connector housing. The lock-releasing means is provided with release portions for engaging said resilient levers on the one connector housing when said connector housings are proper by coupled with each other.

In the connector of still another embodiment of the present invention, the second locking means constitute a withdrawal locking mechanism including a resilient plate extending from said detecting spacer and a pair of protrusions formed on the interior of the one connector housing. The resilient plate is provided with a window in the front portion and a pair of outside protrusions at the opposite sides of the rear portion. The window is adapted to receive the end of said lock piece on the one connector housing when said lock piece is elastically deflected by said lock pawl on the other connector housing. The protrusions of the one connector housing are adapted to lightly engage with said outside protrusions on said resilient plate respectively to prevent said detecting spacer from being withdrawn from the one connector housing. The lock-releasing means can be operated by manually pulling said detecting spacer from the one connector housing when said connector housings are properly coupled with each other.

The light engagement between the protrusions on the resilient plate and the one connector housing constitute a temporal locking mechanism for the detecting spacer. The temporal locking mechanism can be easily released by a manual force.

In this embodiment, when the locking mechanism is normally locked, the lock piece which is recovered to the original position does not interfere with the detecting spacer. Consequently, the detecting spacer can be freely pulled from the one connector housing. When the lock piece is deflected due to poor coupling, the lock piece interferes with the spacer so that the spacer can not be pulled. Accordingly, judgement of proper coupling depend on the ability to withdraw the detecting spacer.

In the connector of still another embodiment of the present invention, the second locking means constitute a withdrawal locking mechanism including a resilient plate extending from said detecting spacer and a pair of resilient levers formed on the one connector housing. The resilient plate is provided with a window in the front portion and a recess at the opposite sides of the medial portion. The resilient levers are adapted to engage with said recesses respectively to prevent said detecting spacer from being withdrawn from the one connector housing. The window is adapted to receive said lock piece when said lock piece is elastically deflected by said lock pawl on the other housing. The lock-releasing means is provided with release portions for engaging said resilient levers on the one connector housing when said connector housings are properly coupled with each other.

In the connector of still another embodiment of the present invention, the detecting spacer is provided with a barcode-indication portion having given barcodes.

In this embodiment, the photo-sensor can scan the barcode indications on the detecting spacers withdrawn from the connector to detect the proper coupling connectors. If the withdrawn spacers are arranged together so that the photo-sensor can readily scan them, the detection for proper coupling of the wiring harness for car can be systematically and efficiently effected.

DETAILED DESCRIPTION OF THE PREFERRED EMBODIMENTS

Figure 1:
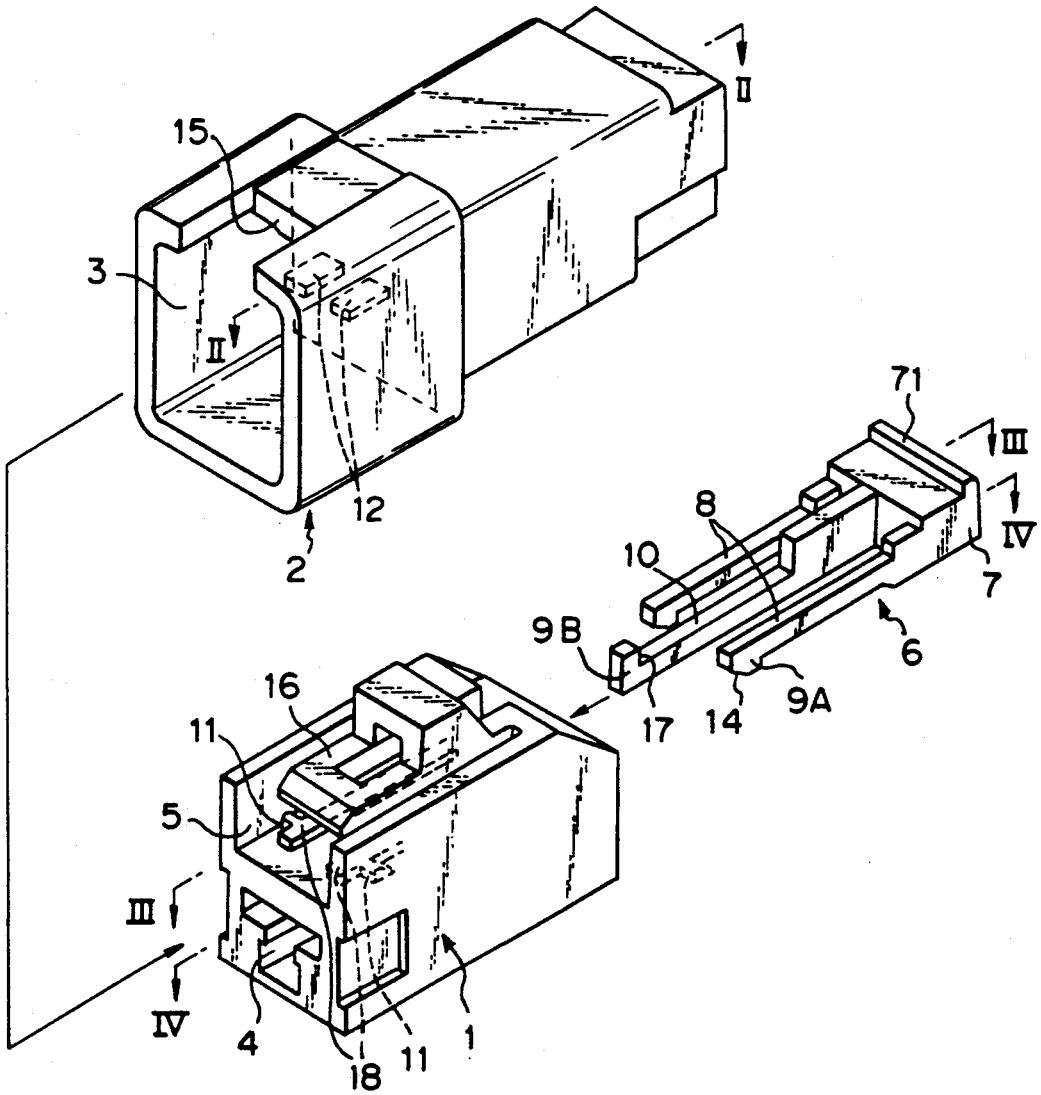
FIG. 1 is an exploded perspective view of a first embodiment of a connector according to the present invention.
Figure 2:
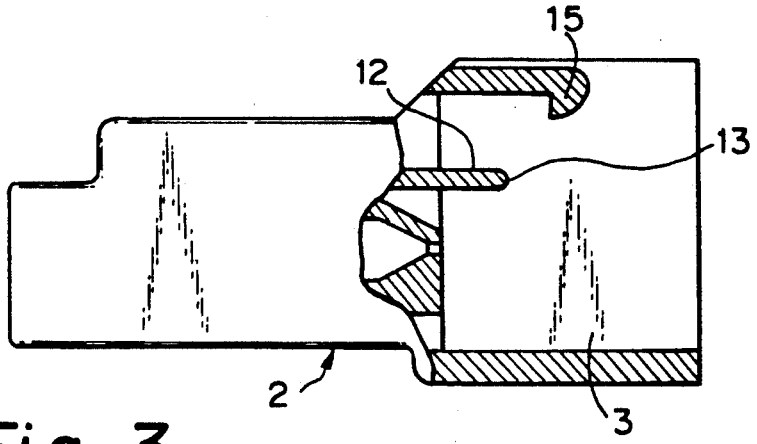
FIG. 2 is a partially cutaway side view taken along the line II—II of FIG. 1.
Figure 3:
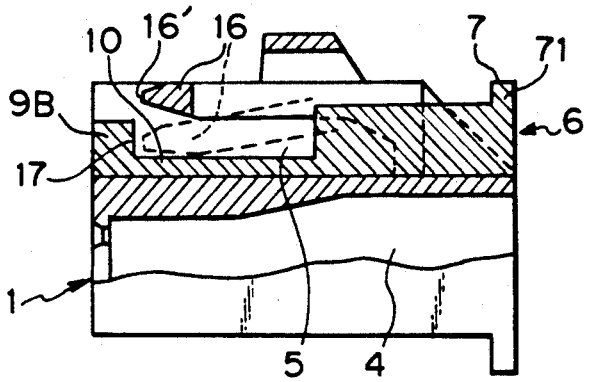
FIG. 3 is a partially cutaway side view taken along the line III—III of FIG. 1.

Referring to FIGS. 1 to 3, a first embodiment of a connector according to the present invention will be described below. As shown in FIGS. 1 and 2, in a connector in which the front half portion of the mating portion 3 of a male connector housing 2 (hereinafter, simply referred to as a male housing 2) accommodating a male terminal (not shown) is mated with the front half portion of a female connector housing 1 (hereinafter, simply referred to as a female housing 1) accommodating a female terminal (not shown) for connection of the terminals accommodated in the both housings.

A spacer accommodating portion 5 is provided above a terminal accommodating portion 4 of the female housing 1, and a separate detecting spacer 6 is inserted thereinto from the rear of the spacer accommodating portion 5 as to be locked thereat with the leading end of the detecting spacer 6 facing forward.

To be specific, as shown in FIG. 1, the detecting spacer 6 is provided with two parallel cantilever-like resilient locking fingers 8 extending forward from a base portion 7 and a first locking pawl 9A downwardly projecting is formed on the underside of the free end of each resilient locking finger 8. On top of this, a cantilever-like downward flexing detecting finger 10 extending forward from the base portion 7 in parallel with the pair of resilient locking fingers 8 and having a second locking pawl 9B projecting form the upper side of the free end thereof is provided centrally between the pair of resilient locking finger 8.

Figure 4:
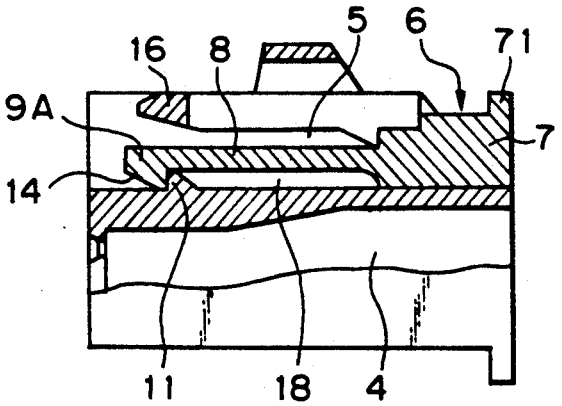
FIG. 4 is a partially cutaway side view taken along the line IV—IV of FIG. 1.

The spacer accommodating portion 5 for receiving the detecting spacer 6 is formed in the upper portion of the female housing 1 in such a manner as to longitudinally extend therethrough, and elongate guide projections 18 each having a locking portion 11 at the front end thereof are provided on both sides of the bottom portion of the spacer accommodating portion 5 in a longitudinal direction. When the detecting spacer 6 is inserted into the spacer accommodating portion 5 from the rear of the female housing 1 so as to be secured thereto, as shown in FIG. 4, the first locking pawls 9A of the resilient locking fingers 8 which are in a free state are then brought into mesh engagement with the locking portions 11 on the leading end of the respective elongate guide projections 18, whereby the detecting spacer 6 is locked so as not to be withdrawn.

The first locking pawls 9A when in a locking posture confront the lock-releasing portion 12 (to be described later) of the male housing 2 into which the locking pawls 9A are fitted, and a "knob portion" 71 formed on the base portion 7 is used when the detecting spacer is withdrawn.

Furthermore, as shown in FIGS. 2 and 3, the downward flexing detecting finger 10 extends in parallel with the locking member 16 (to be described later) of the female housing 1 thereunder, and the second locking pawl 9B projecting from the upper side of the leading end of the downward flexing detecting finger 10 extends forward beyond the leading end 16' of the locking member 16 such that a rear wall 17 of the second locking pawl 9B is situated forward beyond the leading end 16' of the locking member 16. When the locking member 16 is downwardly flexed so as to allow the female and male housings 1, 2 to be coupled together, as shown in FIG. 3, the leading end 16' of the locking member 16 which is in a downward flexing posture is then situated rearwardly of the locking wall 17 of the second locking pawl 9B as indicated by the dotted line in the figure, whereby the withdrawal of the detecting spacer 6 is prevented. Thus, the downward flexing detecting finger 10 has a configuration meeting configurational requirements for the prevention of withdrawal of the detecting spacer 6. This locking wall 17 constitutes the engaging portion which abuts the leading end 16' of the locking member 16 flexed downwardly.

Figure 5A:
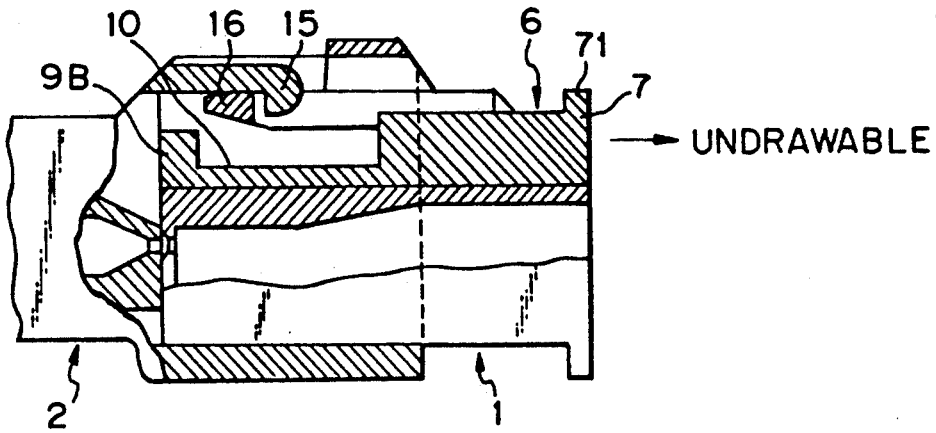
FIGS. 5A, 5B, 5C and 5D are partially cutaway side views showing several coupling states of the connector of FIG. 1, respectively.
Figure 5B:
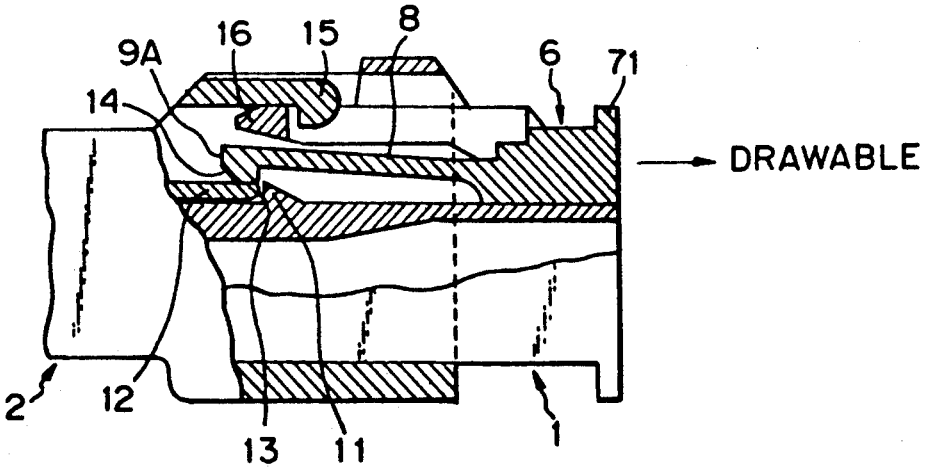

The tongue-like lock-releasing portion 12 (FIG. 1) protruding forward is provided on the rear bottom portion of the mating portion 3 of the male housing 2 in order to release a withdrawal locking means so as not only to make the detecting spacer 6 free when the female and male housings 1, 2 are properly coupled together but also to function as a rib for preventing twisting of the housing. As shown in FIGS. 5A and 5B, this lock-releasing portion 12 has relative position and configuration such that when the female and male housings 1, 2 are in a proper coupled posture, the leading end 13 of the lock-releasing portion 12 comes nearer to and confronts the locking portion 11 on the male housing 2 side so as to forcibly move upward the first locking pawls 9A of the resilient locking fingers 8 which are in mesh with the locking portion 11 thereby to resiliently flex the resilient locking fingers 8 upward, the engagement between the resilient locking fingers 8 and locking portions 11 being thus released.

In order to effect the forcible moving up of the locking fingers 8 by means of the lock-releasing portion 12 in a smooth fashion, a guide taper 14 is imparted to the front end of the first locking pawl 9A.

In addition, a locking mechanism is provided in the female and male housings 1, 2 which comprise a locking pawl 15 on the male housing 2 side and a resilient cantilever-like locking member 16 on the female housing 1 side, and when the female and male housings 1, 2 are properly coupled together, the locking pawl 15 downwardly flexes the leading end of the locking member 16, and when the housings are finally coupled, the downwardly flexing of the locking member 16 is released, and the locking member 16 is restored to its free state, whereupon the locking pawl 15 and locking member 16 are brought into mesh engagement with each other, the housings being thereby locked in the coupled posture.

Thus, the detecting spacer 6 and the lock-releasing portion 12 constitute the coupled posture detecting mechanism and the lock confirming mechanism for a coupled posture for the female and male housings 1, 2, respectively.

In the connector described above, when the housings are properly coupled together with the locking member 16 and the locking pawl 15 being put in a proper locked posture, as shown in FIGS. 5A and 5B, the leading end 13 of the lock-releasing portion 12 of the male housing 2 forcibly moves upward the first locking pawl 9A which is locked at the locking portion 11 so as to release the first locking pawl 9A from the locked state, and since the locking member 16 in a proper locked position is then restored to its free posture, there is no interference between the locking member 16 and the second locking pawl 9B, which allows the detecting spacer 6 to be freely withdrawn. Thus, the connector which is properly coupled together without the detecting spacer 6 is judged as being a properly locked connector.

Figure 5C:
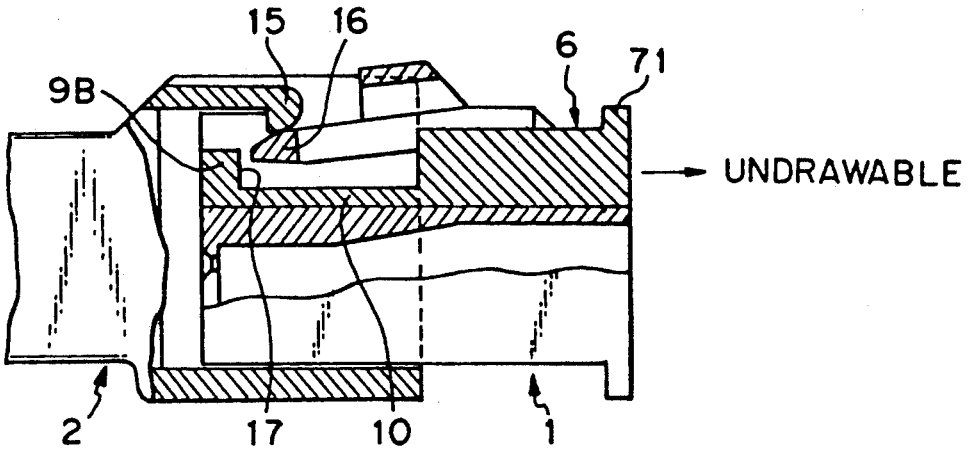
Figure 5D:
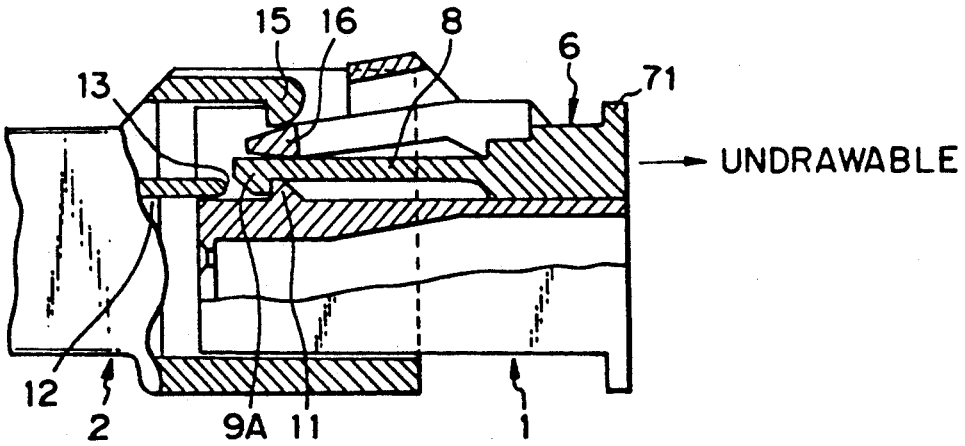

In the case of partial coupling in which a distance by which the female and male housings 1, 2 are coupled together is too short, as shown in FIGS. 5C and 5D, the distance in which the lock-releasing portion 12 moves forward is too short, and the front end 13 cannot move upward the first locking pawl 9A of the detecting spacer 6 which is in a locked state to a sufficient extent, which allows the detecting spacer 6 to remain in a locked state with the locking member 16 in a downward flexing posture interfering with the locking wall 17 of the second locking pawl 9B, thereby prohibiting the detecting spacer 6 from being withdrawn. Thus, the connector with the detecting spacer 6 is judged as being a defective connector having coupling or locking errors.

Moreover, since this connector has a double locking mechanism for the "restriction of withdrawal of the detecting spacer 6" by means of the first and second locking pawls 9A, 9B, high reliability can be obtained.

Figure 6:
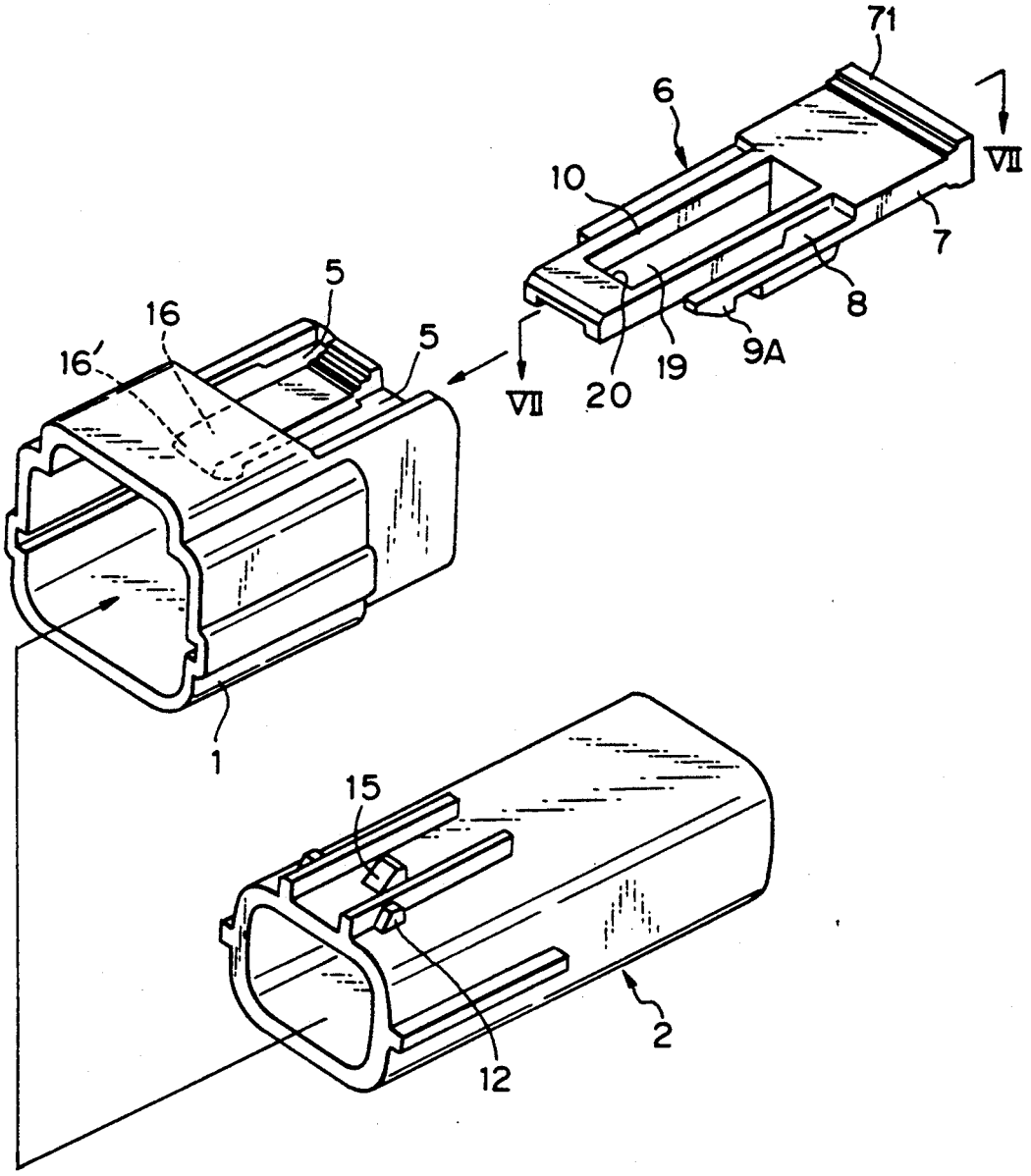
FIG. 6 is an exploded perspective view of a second embodiment of the connector according to the present invention.
Figure 7:
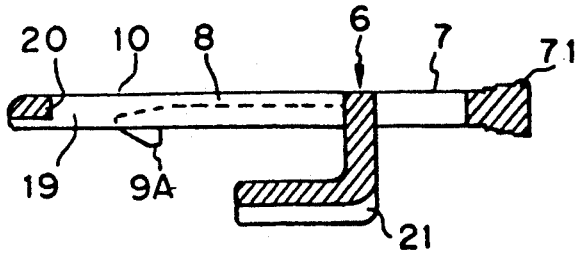
FIG. 7 is a partially cutaway side view taken along the line VII—VII of FIG. 6.

Referring now to FIGS. 6 to 8, the second embodiment of the present invention will be described below. The connector of this embodiment includes a coupling posture locking mechanism with the locking member 16 which mates with the locking pawl 15 of the male connector housing 2. The connector can receive in the portion 5 in the female housing 1 the detecting spacer 6 having the same resilient locking finger 8 and the detecting member 10 as those of the first embodiment. The male housing 2 is provided with the lock-releasing portion 12 on the top surface. The detecting member 10 of the detecting spacer 6 is provided with a window 19 for receiving the locking member at the front portion of the member 10. The front edge of the window 19 defines an engaging portion 20.

In order to mate the locking member 15 with the window 19, the window 19 receives the free end 16' of the locking member 16 deflected upwardly. Then, the free end 16' contacts with the engaging portion 20 to prevent the detecting member 10 from being withdrawn. In the drawing, a member 21 serves to prevent the play between the detecting spacer 6 and the female housing 1 when connected.

Figure 8A:
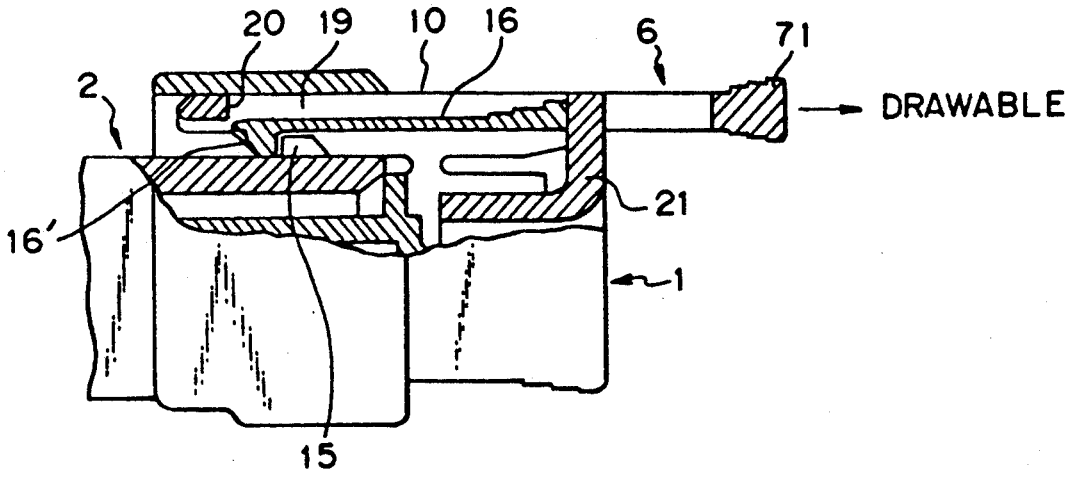
FIGS. 8A, 8B, 8C and 8D are partially cutaway side views showing several coupling states of the connector of FIG. 6.
Figure 8B:
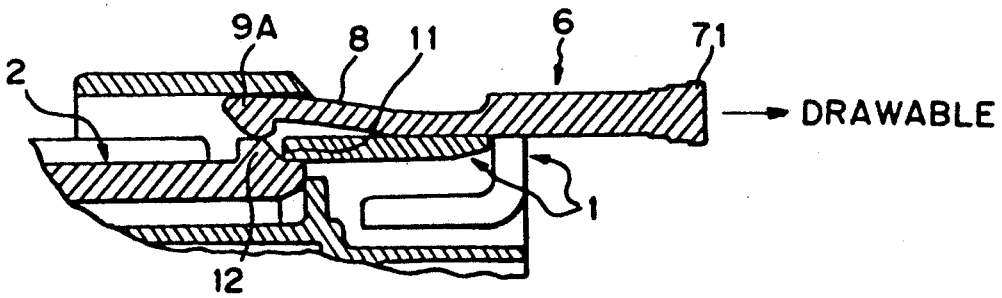

In the connector of the second embodiment, when the female and male housings 1 and 2 are properly coupled with each other so that the locking member 16 engages normally with the locking member 15, as shown in FIGS. 8A and 8B, the resilient locking fingers 8 which were mated with the locking portions 11 of the female housing 1 is released from the portions 11 by the lock-releasing portion 12. The locking member 16 which normally engages the locking member 15 recovered to the free posture does not interfere with the engaging portion 20 of the detecting spacer 6 thereby causing the spacer to be free.

Figure 8C:
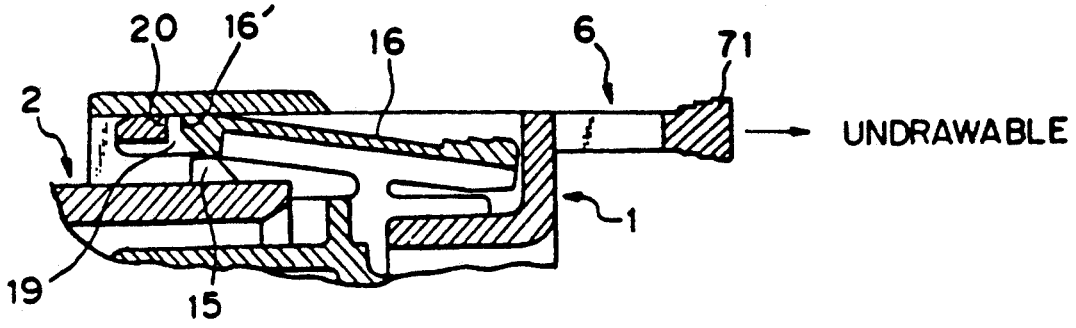
Figure 8D:
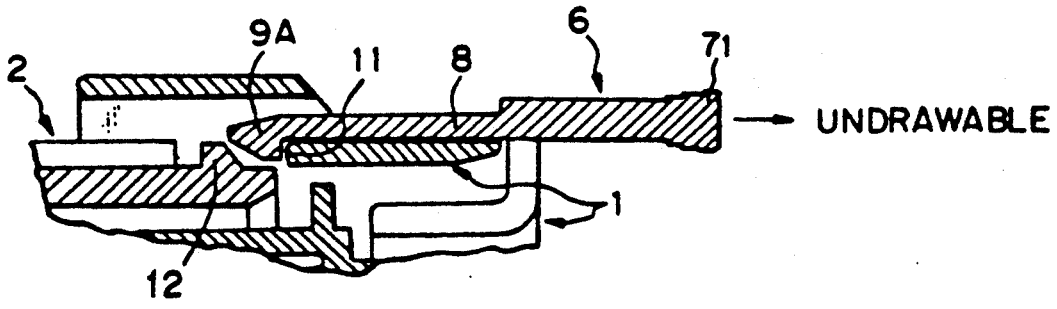

When the amount of coupling is small, as shown in FIGS. 8C and 8D, the resilient locking finger 8 is kept in the withdrawal locking condition due to limited advance of the portion 12 and the free end 16' of the locking member 16 deflected upwardly engages the portion 20 of the detecting member 10, thereby prevent the spacer 6 from being withdrawn.

The embodiment of the connector as described above has the above-mentioned function in which whether the coupled posture of the connector is proper or improper can be judged by visually or feelingly confirming the existence/absence of the detecting spacer 6, as well as effectiveness in which the overall coupling conditions can be checked through the administration of the number of detecting spacers withdrawn. For instance, painting the detecting space 6 "red" or another colour which is easy to recognize facilitates the judgement of the existence/absence of the detecting spacer. In addition, since it is possible to feelingly confirm the existence/absence of the detecting spacer, the connector of the present invention is extremely suitable for use for a wire harness for an automobile in which connector housings are connected together by feel, or in which visual grasping of the connector conditions is difficult, and when used for such a purpose, it is possible to prevent the occurrence of coupling errors in advance, and since there is no limitation to the direction in which a connector is mounted, and moreover since the insertion and withdrawal of the detecting spacer 6 can be limited to one of the connector housings, the connector of the present invention can be used as a coupling detecting mechanism even for a connector for an apparatus in which the other connector housing is secured to the apparatus. In addition, in a case where the connector is used at a position where coupling detection is not necessary, it is possible to use the connector without the detecting spacer as a normal connector. Further, a material control of the withdrawn detecting spacers can detect uncoupled connectors.

Referring now to FIGS. 9 to 11A and 11B, the third embodiment will be described below. A spacer accommodating portion 5 is formed above a terminal accommodating portion 4 of the female housing 1, and a separate detecting spacer 6 is inserted thereinto from the rear of the spacer accommodating portion 5 so as to be locked thereat with the leading end of the detecting spacer 6 facing forwardly.

Figure 9:
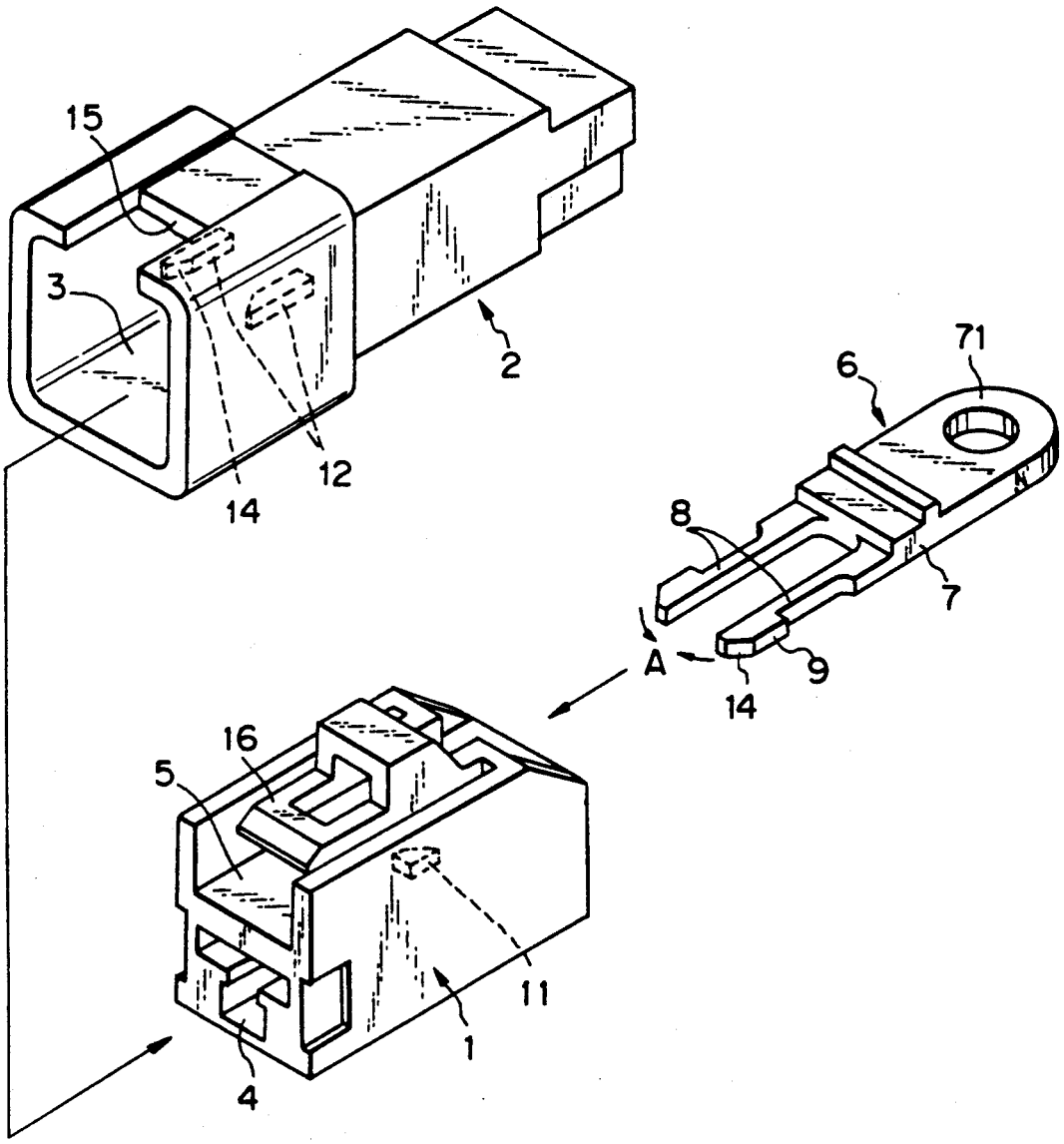
FIG. 9 is an exploded perspective view of a third embodiment of a connector according to the present invention.
Figure 10:
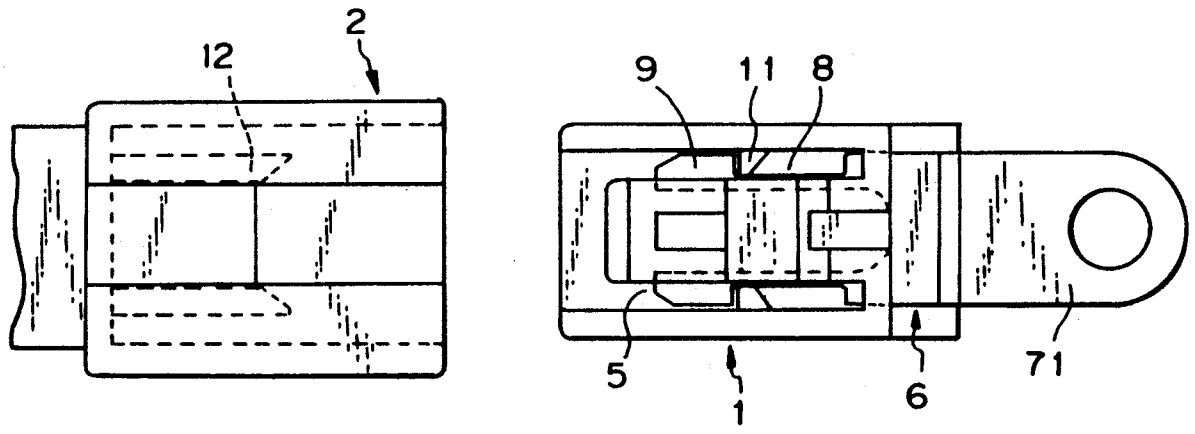
FIG. 10 is a plan view showing a state in which the connector of FIG. 9 is separated.

To be specific, as shown in FIG. 9, the detecting spacer 6 is provided with two parallel cantilever-like resilient locking members 8 extending forward from a base portion 7, and a first locking pawl 9 sidewardly projecting is formed on the underside of the free end of each resilient locking member 8. The spacer accommodating portion 5 for receiving the detecting spacer 6 is formed in the upper portion of the female housing 1 in such a manner as to longitudinally extend therethrough. A locking portion 11 at the front end thereof are provided on both sides of the bottom portion of the spacer accommodating portion 5 in a longitudinal direction. When the detecting spacer 6 is inserted into the spacer accommodating portion 5 from the rear of the female housing 1 so as to be secured thereto, as shown in FIG. 10, the locking pawls 9 of the resilient locking fingers 8 which are in a free state are then brought into mesh engagement with the locking portions 11, whereby the detecting spacer 6 is locked so as not to be withdrawn.

The locking pawls 9 when in a locking posture confront a lock-releasing portion 12 (to be described later) of the male housing 2 into which the locking pawls 9 are fitted, and a "knob portion" 21 formed on the base portion 7 is used when the detecting spacer is withdrawn.

The bar-like lock-releasing portion 12 protruding forward is provided on the rear bottom portion of the mating portion 3 of the male housing 2. When the female and male housings 1 and 2 are properly coupled together, the portion 12 engages the free end of the resilient locking finger 8 of the female housing 1, thereby deflecting the finger 8 in the arrow A in FIG. 9. Then, the locking pawl 9 is released from the portion 11 so that the detecting spacer can be withdrawn.

In order to effect the forcible lateral movement of the locking member 8 by means of the lock-releasing portion 12 in a smooth fashion, a guide taper 14 is imparted to the front end of the locking pawl 9.

The locking members 16 and 15 constitute the coupling posture locking mechanism.

Figure 11A:
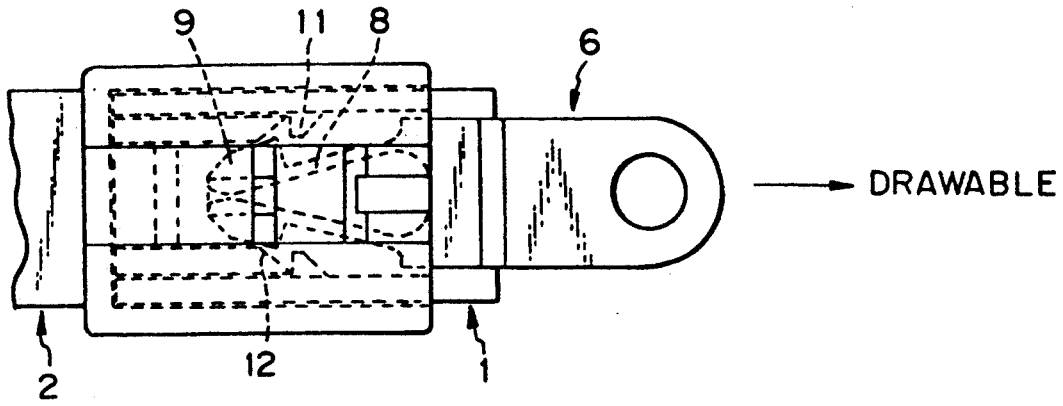
FIGS. 11A and 11B are plan views showing several coupling states of the connector of FIG. 9.

In the connector having the detecting spacer described above, when the housings are properly coupled together with the locking member 16 and the locking pawl 15 being put in a proper locked posture, as shown in FIG. 11A, the leading end of the lock-releasing portion 12 of the male housing 2 forcibly moves sideward the locking finger 8 which is locked at the locking portion 11 so as to release the first locking pawl 9A from the locked state, and since the locking member 16 in a proper locked position is then restored to its free posture, there is no interference between the locking member 16 and the second locking pawl, which allows the detecting spacer 6 to be freely withdrawn. Thus, the connector which is properly coupled together without the detecting spacer 6 is judged as being a properly locked connector.

Figure 11B:
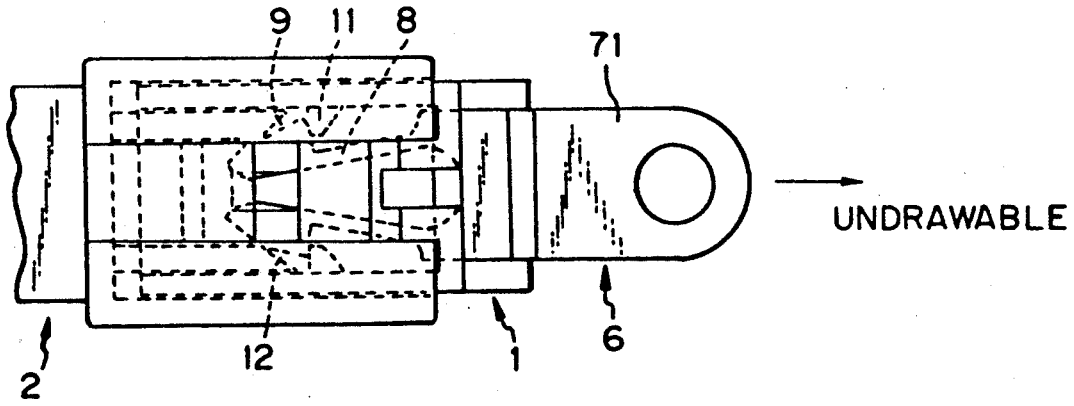

In the case of partial coupling in which a distance by which the female and male housings 1, 2 are coupled together is too short, as shown in FIG. 11B, the distance in which the lock-releasing portion 12 moves forward is too short, and the front end cannot move upward the locking pawl 9 of the detecting spacer 6 which is in a locked state to a sufficient extent, which allows the detecting spacer 6 to remain in a locked state, thereby prohibiting the detecting spacer 6 from being withdrawn. Thus, the connector with the detecting spacer 6 is judged as being a defective connector having the coupling or locking errors.

Referring now to FIGS. 12 to 14A and 14B, the fourth embodiment will be described below. The connector of this embodiment includes the same detecting spacer 6 and lock-releasing portion 12 as those of the third embodiment shown in FIG. 9. The detecting spacer has the resilient locking member 8 in the form of a resilient plate which is provided with a locking recess 17 at the opposite sides.

Figure 13:
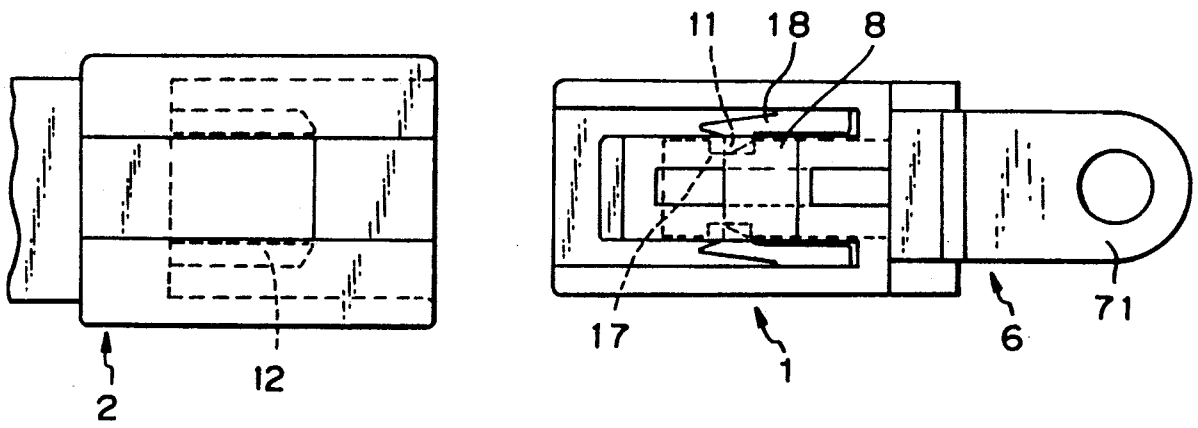
FIG. 13 is a plan view showing a state in which the connector of FIG. 12 is separated.

The spacer accommodating portion 5 is provided with cantilever-like resilient members 18 on the opposite side walls. The member 18 extends along the inserting direction of the detecting spacer 6 and has the engaging portion 11 at the free end for engaging the locking recess 17. When the detecting spacer 6 is inserted into the spacer accommodating portion 5 from the rear of the female housing 1, as shown in FIG. 13, the engaging portion 11 of the member 18 is brought into mesh engagement with the locking recess 17, whereby the detecting spacer 6 is locked so as not to be withdrawn.

The male housing 2 is provide with the bar-like lock-releasing portion 12 on the mating portion 3 of the male housing 2. When the female and male housings 1 and 2 are properly coupled together, the leading end of the portion 12 engages the free end 11 of the resilient member 18 so as to elastically deflect outwardly. Then, the free end 11 is released from the recess 17. The portion 12 is formed into the taper face 14.

Figure 14A:
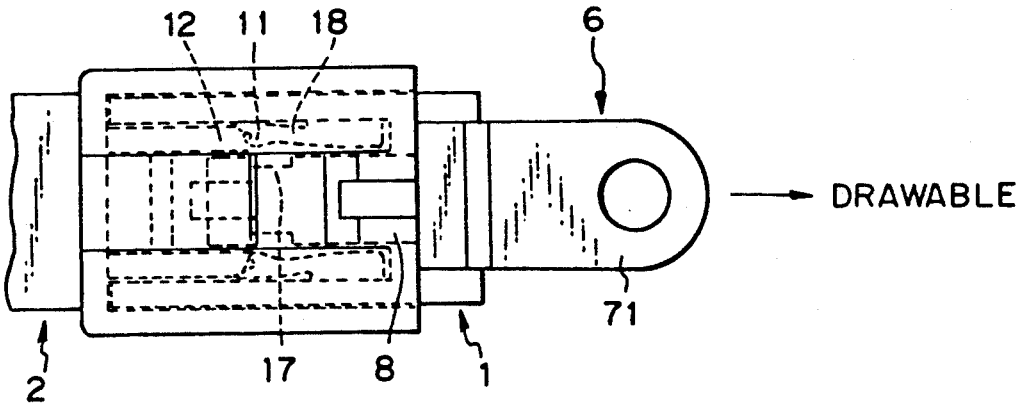
FIGS. 14A and 14B are plan views showing several coupling states of the connector of FIG. 12.
Figure 14B:
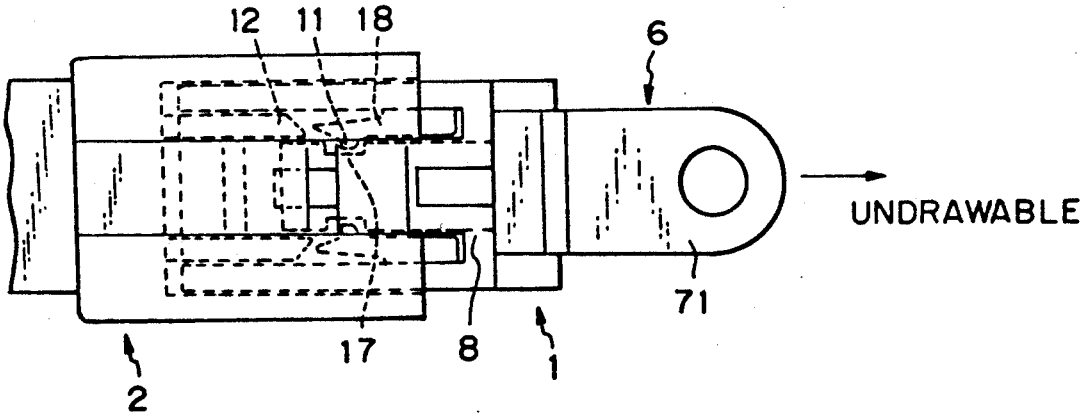

In the connector of this embodiment, when the female and male housings 1 and 2 are properly coupled with each other, as shown in FIGS. 14A and 14B, the withdrawal locking means for the detecting spacer 6 is released by the lock-releasing portion 12 so as to freely withdraw the spacer 6 (see FIG. 14A). When they are partially coupled with each other, the detecting spacer 6 can not be pulled from the housing 1 since the locking condition of the resilient member 8 is maintained due to limited advance of the portion 12.

Referring now to FIGS. 15 to 17A and 17B, the fifth embodiment of the present invention will be described below. The front half portion of the mating portion 3 of the male housing 2 is mated with the front half portion of the female housing 1. The resilient cantilever-like locking member 16 formed on the upper portion of the female housing 1 engages the locking pawl 15 formed on the male housing 2. The locking pawl 15 and the locking member 16 constitute the locking mechanism.

The spacer accommodating portion 5 is defined below the locking member 16 in the female housing 1. As described above, the detecting spacer 6 is inserted into the portion 5. The detecting spacer is provided with a detecting plate 73 extending from the base portion 7. The detecting plate 73 has a window 61 at the front portion and lock protrusions 22 at the opposite sides of the medial portion. The window 61 defines an engaging wall 24 at the front edge.

The locking member has a detecting protrusion 31 at the bottom of the free end thereof. When the detecting spacer 6 is inserted into the spacer accommodating portion 5, the detecting protrusion 31 of the member 16 is disposed above the window 61 of the spacer 6. The protrusion 31 is inserted into the window 61 when the member 16 is elastically deflected downwardly by the locking pawl 15. Then, the leading edge of the protrusion 31 abuts the engaging wall 24, thereby preventing the detecting space 6 from being pulled from the female housing 1.

The spacer accommodating portion 5 is provided with locking pawl 23 at the opposite side wall when the detecting spacer 6 is properly mounted in the female housing 1 the locking pawls are lightly mated with each other, thereby preventing the spacer from being withdraw. However, the detecting spacer can be readily pulled from the female housing 1 by a light manual force. In this detecting spacer 6, the end portion 71 of the base portion 71 projects from the end wall of the female housing 1. This portion 71 will provide confirmation of the spacer mounting and a knob for pulling.

Figure 15:
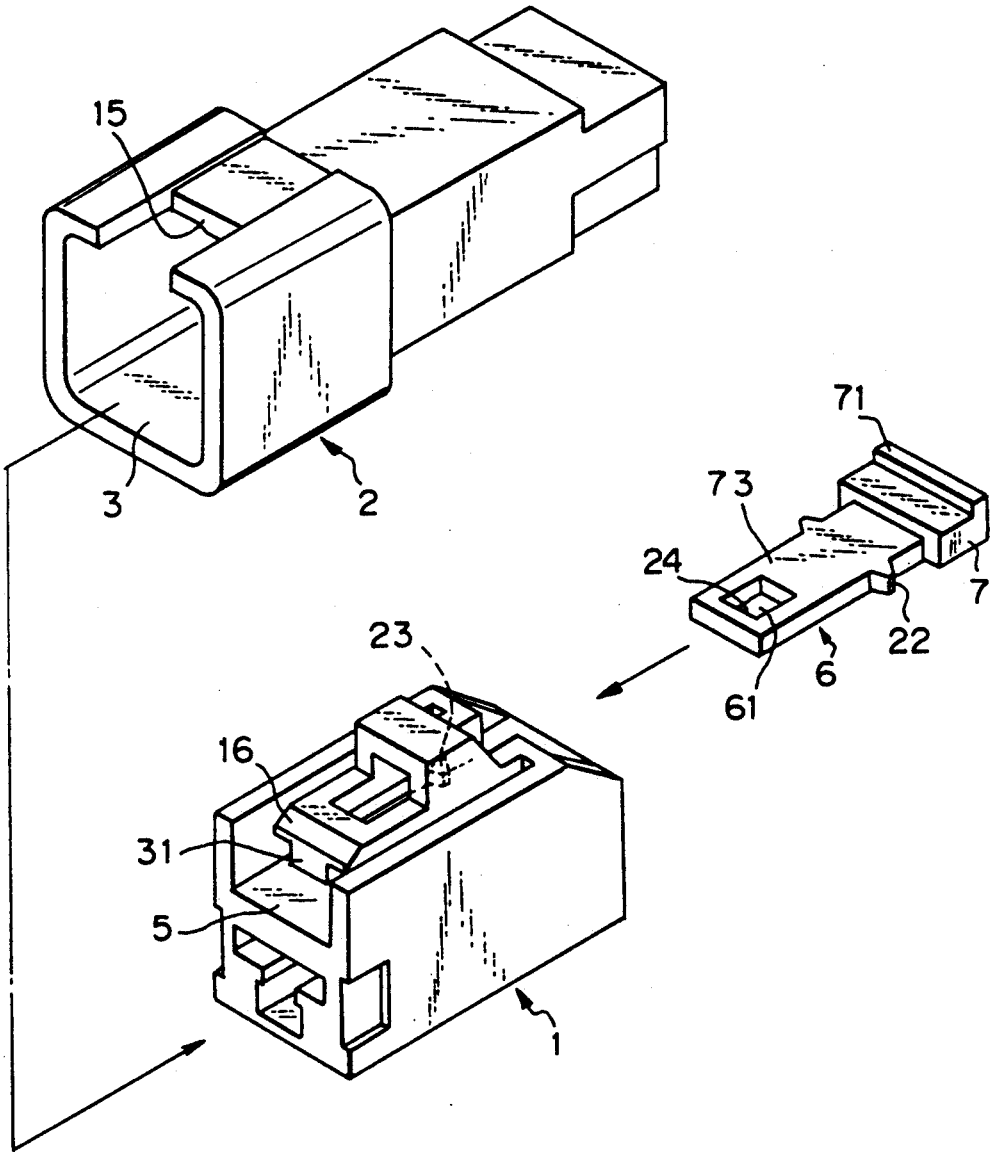
FIG. 15 is an exploded perspective view of a fifth embodiment of the connector according to the present invention.
Figure 16:
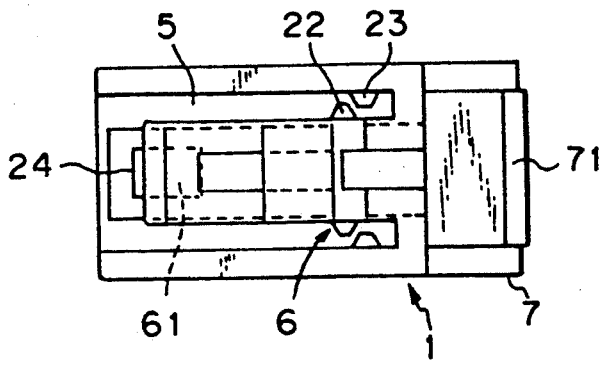
FIG. 16 is a plan view showing a coupling state of a female connector housing and a detecting spacer.
Figure 17A:
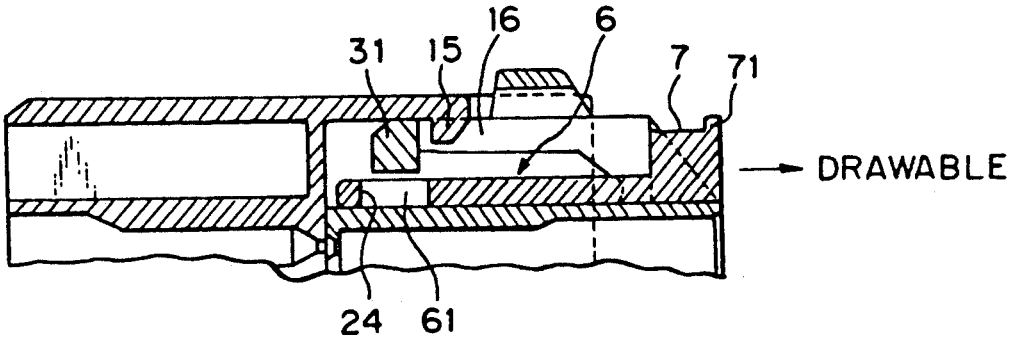
FIGS. 17A and 17B are partially cutaway side views showing several coupling states of the connector of FIG. 15.
Figure 17B:
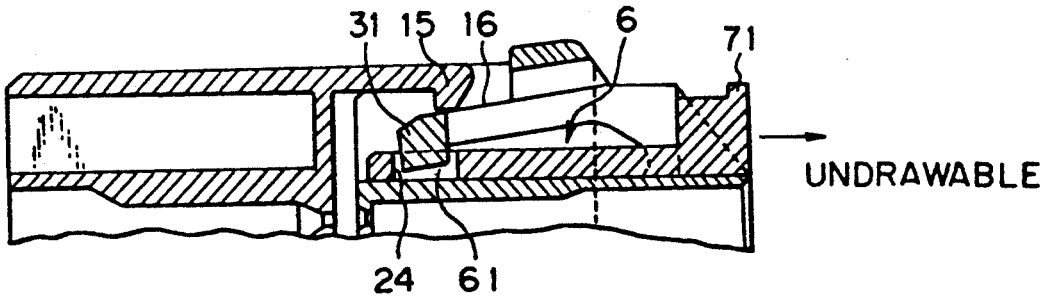

In the connector shown in FIG. 15, when the locking member 16 is properly mated with the locking pawl 15, the detecting protrusion 31 of the locking member 16 is released from the window 61 in the spacer 6 so that the spacer is freely withdrawn (FIG. 17A). When the locking member 16 is deflected downwardly due to the defective coupling, the protrusion 31 remains in the window 61 so that the spacer 6 can not be pulled out (FIG. 17B). Thus, the absence of the detecting spacer 5 or the spacer 5 capable of withdrawing indicates the proper coupling of the connector.

Figure 18:
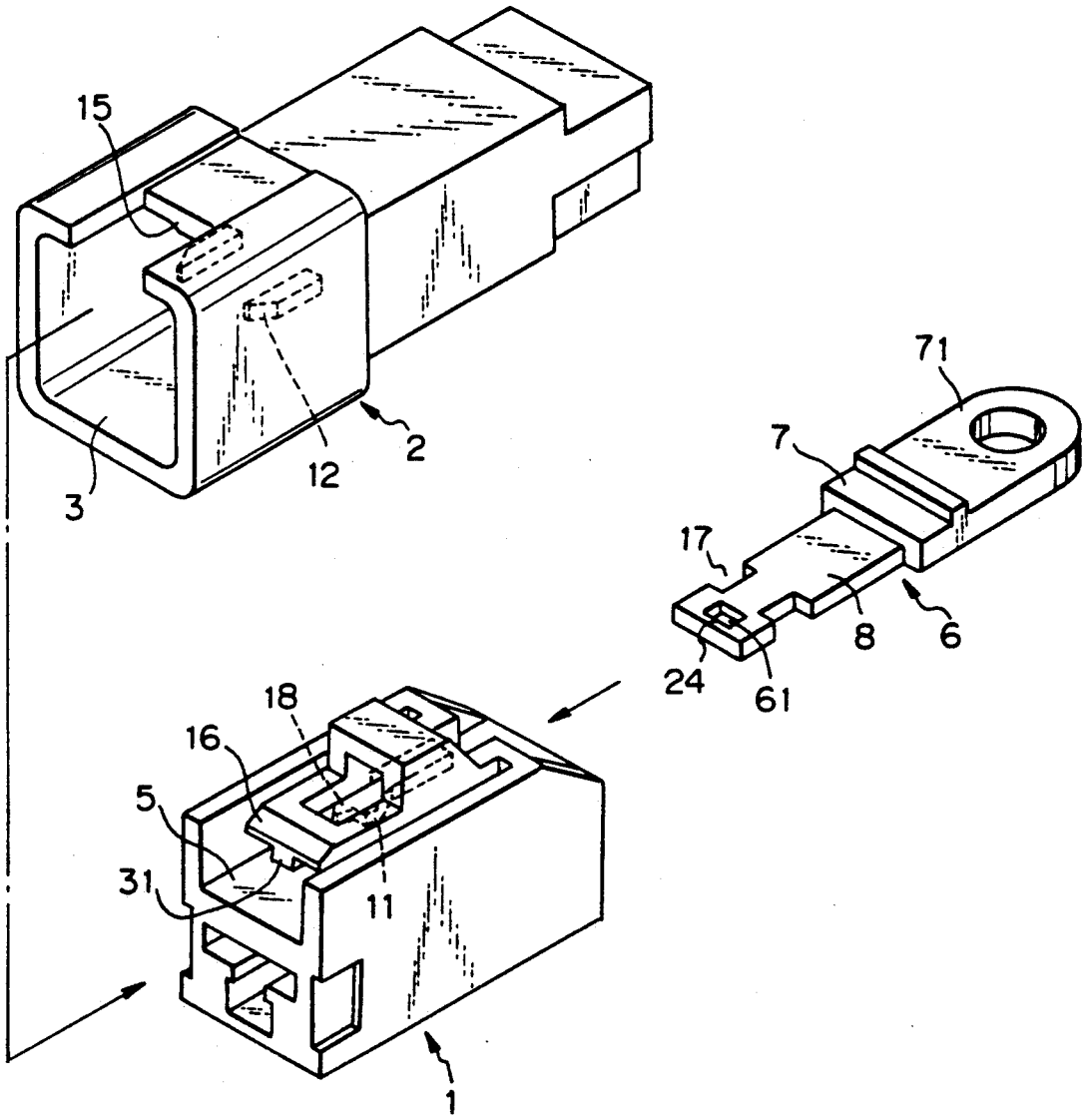
FIG. 18 is an exploded perspective view of a sixth embodiment of the connector according to the present invention.
Figure 19A:
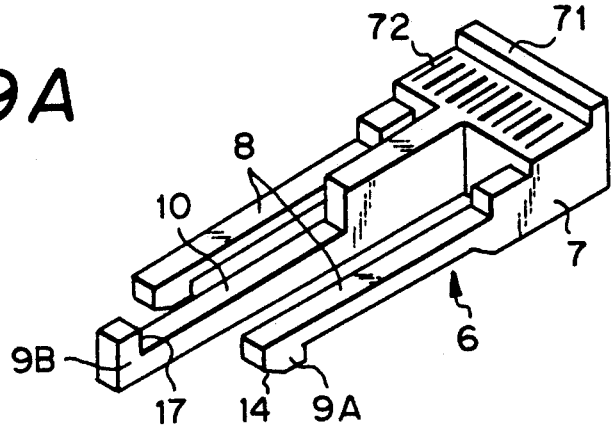
FIGS. 19A, 19B, 19C, 19D, 19E, and 19F are perspective views of another embodiment of several types of the detecting spacers to be used in the connector of the present invention.
Figure 19B:
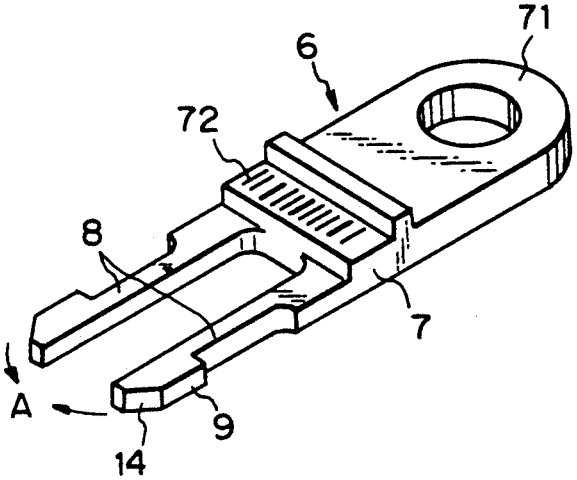
Figure 19C:
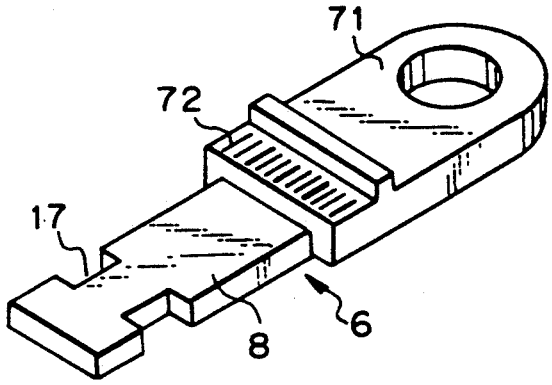
Figure 19D:
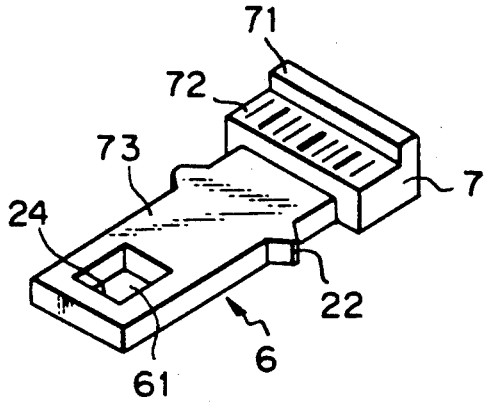
Figure 19E:
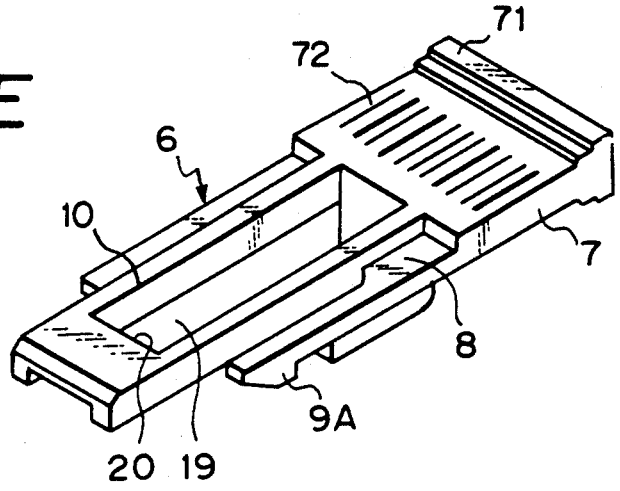
Figure 19F:
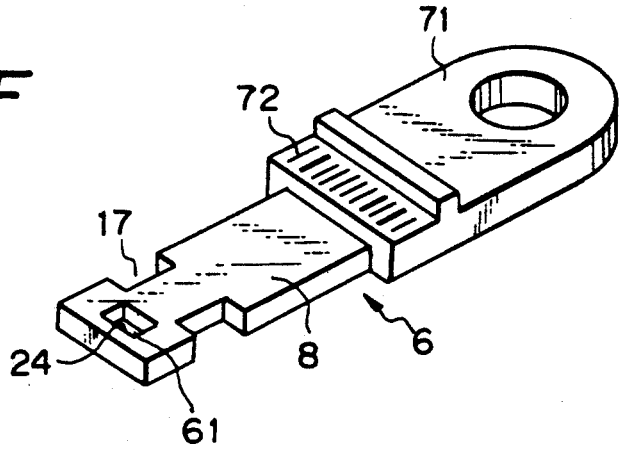

Referring now to FIG. 18, the sixth embodiment of the present invention will be described below. The sixth embodiment is a combination of the fourth and fifth embodiments shown in FIGS. 12 and 15. The detecting spacer 6 has the locking recesses 17 with the engaging wall 24 and the window 61. The female housing 1 has the resilient cantilever-like locking member 18 with the locking portion 11 as shown in FIG. 12 while the male housing 2 has the lock-releasing portion 12 as shown in FIG. 15.

Figure 12:
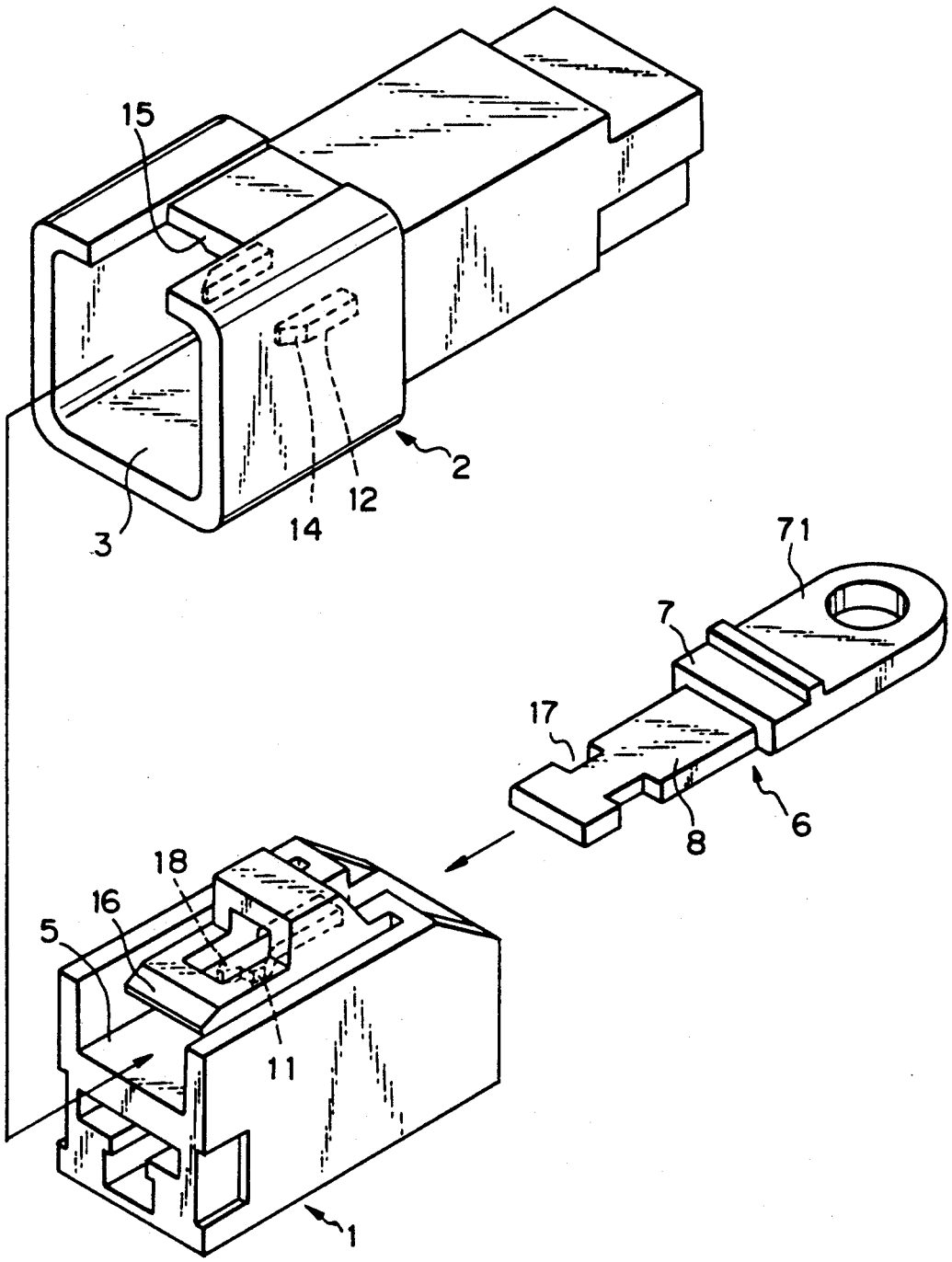
FIG. 12 is an exploded perspective view of a fourth embodiment of the connector according to the present invention.

The connector shown in FIG. 18 has an operational effect combined with those of the connectors shown in FIGS. 12 and 15. It is possible in this embodiment to detect the improper coupling and defective locking between the female and male housings 1 and 2.

The embodiment of the connector as described above has the above-mentioned function in which whether the coupled posture of the connector is proper or improper can be judged either visually or by feel confirming the existence/absence of the detecting spacer 6, as well as effectiveness in which the overall coupling conditions can be checked through the administration of the number of detecting spacers withdrawn. For instance, painting the detecting space 6 "red" of the like which is easy to recognize facilitates the judgement of the existence/absence of the detecting spacer. In addition, since it is possible to feelingly confirm the existence/absence of the detecting spacer, the connector of the present invention is extremely suitable for use for a wiring harness for an automobile in which connector housings are connected together by feel, or in which visual grasping of the connector conditions is difficult, and when used for such a purpose, it is possible to prevent the occurrence of coupling errors in advance, and since there is no limitation to the direction in which a connector is mounted, and moreover since the insertion and withdrawal of the detecting spacer 6 can be limited to one of the connector housings, the connector of the present invention can be used as a coupling detecting mechanism even for a connector for an apparatus in which the other connector housing is secured to the apparatus. In addition, in a case where the connector is used at a position where coupling detection is not necessary, it is possible to used the connector without the detecting spacer as a normal connector. Further, a material control of the withdrawn detecting spacers can detect uncoupled connectors.

Referring now to FIGS. 19A to 19F, the seventh embodiment of the present invention will be described below. In this embodiment, a label with printed barcodes is applied to the top flat face on the base portion 7 of the detecting spacer 6 used in each of the embodiments described above to define a barcode indication 72.

The barcode contains any control information such as arranged position or kinds of the connectors.

In this embodiment, the photo-sensor can scan the barcode indications on the detecting spacers withdrawn from the connector to detect the proper coupling connectors. If the withdrawn spacers are arranged together so that the photo-sensor can readily scan them, the detection for proper coupling of the wiring harness for car can be systematically and efficiently effected.

The barcode indication 72 may be provided on not only the out side of the spacer 6 but also the inside of the spacer 6.

In accordance with the present invention, the perfect or proper coupling of the connector can be detected by the visual or touching process such as existence/absence of the detecting spacer, or the withdrawing action of the connector. The connector can be applied to a wiring harness for a car having complicated wiring and limited working space.

What is claimed is:

1. A connector assembly in which the portions of a pair of connector housings each accommodating a terminal are coupled with each other and are locked together by means of a pair of first locking devices, said connector comprising:

a detecting spacer which is locked and removably connected to one of said pair of connector housings by a second locking device; and a lock-releasing device provided on the other connector housing, said lock releasing device being configured so as to release a locked condition of said detecting spacer to said one connector housing when said other connector housing is properly coupled with said one connector housing.

2. A connector as set forth in claim 1;

wherein said first locking devices constitute a posture locking mechanism including a cantilever type of resilient lock piece formed on the one connector housing and a lock pawl formed on the other connector housing, said lock pawl being adapted to engage with said lock piece by elastically deflecting and recovering said lock piece;

wherein said second locking device constitutes a withdrawal locking mechanism including a pair of resilient fingers formed on said detecting spacer and a pair of lock portions formed on the one connector housing, said lock portions being adapted to engage said resilient fingers to prevent said detecting spacer from withdrawing from the one connector housing;

wherein said detecting spacer has a detecting finger adapted to engage with a free end of said lock piece when said lock piece is elastically deflected by said lock pawl; and wherein said lock-releasing device includes a pair of release portions which engage with the ends of said resilient fingers so that said lock-releasing device can release said withdrawal locking mechanism when said connector housings are properly coupled with each other.

3. A connector as set forth in claim 2, wherein each of said resilient fingers has a first downward pawl at its free end, said first downward facing pawl being adapted to engage with said lock portion on the one connector housing;

wherein said detecting finger has a upward facing pawl at its free end, said upward facing pawl being adapted to engage with the free end of said lock piece on the one connector housing when said lock piece is elastically deflected; and wherein each of said release portions is formed into a tongue projected in the interior of the other connector housing and directed to said first downward facing pawl of said resilient finger.

4. A connector as set forth in claim 2, wherein said detecting finger is provided with a window for receiving said lock piece at the front portion and the front edge of said window serves as a stop for the free end of said lock piece.

5. A connector as set forth in any one of claims 1 through 4, wherein said detecting spacer is provided with a barcode-indication portion having given barcodes.

6. A connector as set forth in claim 1, wherein said second locking means constitute a withdrawal locking mechanism including a pair of resilient fingers formed on said detecting spacer and a pair of lock portions formed on the one connector housing, each of said resilient fingers being provided with an outside pawl at the free end, said lock portions being adapted to engage with said outside pawls respectively to prevent said detecting spacer from withdrawing from the one connector housing; and wherein said lock-releasing means is provided with release portions for engaging said outside pawls of said resilient fingers when said connector housings are properly coupled with each other.

7. A connector as set forth in claim 1, wherein said second locking means constitute a withdrawal locking mechanism including a resilient plate extending from said detecting spacer and a pair of resilient levers formed on the one connector housing, said resilient plate being provided with a recess at the opposite sides, said resilient levers being adapted to engage with said recesses respectively to prevent said detecting spacer from being withdrawn from the one connector housing; and wherein said lock-releasing means is provided with release portions for engaging said resilient levers on the one connector housing when said connector housings are properly coupled with each other.

8. A connector as set forth in claim 1, wherein said second locking means constitute a withdrawal locking mechanism including a resilient plate extending from said detecting spacer and a pair of protrusions formed on the interior of the one connector housing, said resilient plate being provided with a window in the front portion and a pair of outside protrusions at the opposite sides of the rear portion, said window being adapted to receive the end of said lock piece on the one connector housing when said lock piece is elastically deflected by said lock pawl on the other connector housing, said protrusions of the one connector housing being adapted to lightly engage said outside protrusions on said resilient plate respectively to prevent said detecting spacer from withdrawing from the one connector housing; and wherein said lock-releasing means can be operated by manually pulling said detecting spacer from the one connector housing when said connector housings are properly coupled with each other.

9. A connector as set forth in claim 1, wherein said second locking means constitute a withdrawal locking mechanism including a resilient plate extending from said detecting spacer and a pair of resilient levers formed on the one connector housing, said resilient plate being provided with a window in the front portion and a recess at the opposite sides of the medial portion said resilient levers being adapted to engage said recesses respectively to prevent said detecting spacer from being withdrawn from the one connector housing, said window being adapted to receive said lock piece when said lock piece is elastically deflected by said lock pawl on the other housing; and wherein said lock-releasing means is provided with release portions for engaging said resilient levers on the one connector housing when said connector housings are properly coupled with each other.

10. A connector as set forth in any one of claims 6 through 9, wherein said detecting spacer is provided with a barcode-indication portion having given barcodes.

* * * * *